US006484912B2

(12) United States Patent
Jones

(10) Patent No.: US 6,484,912 B2
(45) Date of Patent: Nov. 26, 2002

(54) EXPERIENCED BACKPACKER

(76) Inventor: Ani M. Jones, 24805 Argus Dr., Mission Viejo, CA (US) 92690

( * ) Notice: Subject to any disclaimer, the term of this patent is extended or adjusted under 35 U.S.C. 154(b) by 0 days.

(21) Appl. No.: 09/760,144

(22) Filed: Jan. 12, 2001

(65) Prior Publication Data

US 2002/0092882 A1 Jul. 18, 2002

(51) Int. Cl.[7] ..... A45F 4/02

(52) U.S. Cl. ..... 224/153; 224/157; 224/631; 224/634

(58) Field of Search ..... 224/153, 157, 224/576, 577, 631, 633, 634, 636, 655

(56) References Cited

U.S. PATENT DOCUMENTS

| | | | | | |
|---|---|---|---|---|---|
| 3,860,157 | A | * | 1/1975 | Richards et al. | 224/153 |
| 4,169,550 | A | * | 10/1979 | Williams | 224/644 |
| 4,433,802 | A | * | 2/1984 | Woolf | 224/153 |
| 4,449,655 | A | | 5/1984 | Germe | |
| 4,513,866 | A | | 4/1985 | Thomas | |
| 4,718,524 | A | | 1/1988 | Crumley | |
| 5,152,441 | A | * | 10/1992 | Torena | 224/557 |
| 5,381,936 | A | * | 1/1995 | Beery et al. | 224/153 |
| 5,564,612 | A | * | 10/1996 | Gregory | 224/633 |
| 5,573,166 | A | | 11/1996 | Leja | |
| 5,628,443 | A | | 5/1997 | Deutsch | |
| 5,676,296 | A | | 10/1997 | Masters | |
| 5,826,746 | A | | 10/1998 | Ash, Jr. | |
| 5,934,527 | A | | 8/1999 | Von Neumann | |
| 5,961,017 | A | | 10/1999 | Mehler | |
| 6,193,118 | B1 | * | 2/2001 | Kearl | 224/153 |

FOREIGN PATENT DOCUMENTS

| | | | | |
|---|---|---|---|---|
| GB | 19546 | * | 9/1903 | 224/209 |
| GB | 117 | * | of 1860 | 224/209 |

OTHER PUBLICATIONS

Reference 361,688 to Robers, Nov. 1906; the reference appears to be a foreign patent reference and lacks a specification.*

* cited by examiner

*Primary Examiner*—Stephen K. Cronin
(74) *Attorney, Agent, or Firm*—Quirk & Tratos

(57) ABSTRACT

A backpack constructed of two lightweight pieces of pliable material allowing said backpack to be easily stocked and sealed. The single piece of pliable material comprising a top flap, a bottom flap, two side flaps and a support section. The backpack is formed by attaching the two side flaps over the bottom flap which is closed first, the top flap is then folded over the two attached side flaps which along with the support section create a backpack type device. One or more shoulder straps are used to carry the backpack. The support section becomes the portion of the backpack that rests against the user's back while being used. The backpack is filled with essential survival items and the versatility of the backpack allows it to be used as an emergency stretcher when fully opened, emptied of survival items and fitted with stretcher poles.

4 Claims, 3 Drawing Sheets

EXPERIENCED BACKPACKER

FIELD OF THE INVENTION

The present invention relates to a survival backpack capable of storing essential survival items. Two lightweight pieces of pliable material comprised of a top flap, bottom flap, two side flaps and a support section are folded to form a backpack. One or more shoulder straps are used to carry the backpack. The two side flaps are folded over the bottom flap which are each then covered by the top flap which along with the support section create a backpack type device. The support section becomes the portion of the backpack that rests against the user's back while being used. The versatility of the backpack allows it to be used as an emergency stretcher when fully opened, emptied of survival items and fitted with stretcher poles.

BACKGROUND OF THE INVENTION

Beginning in the 80's, continuing through the 90's and into the new millennium, the United States population has become obsessed with fitness. Gyms have popped up on every corner and the sales of home gyms have skyrocketed. In an effort to find new and more exciting ways to stay in shape, people have taken to the outdoors. Hiking and camping have become very popular fitness activities in this country and around the world.

The difference between working out in a gym and moving to the outdoors to hike or camp is the danger associated with the outdoors. Hiking and camping are inherently dangerous since mother nature is unpredictable and it is impossible to plan for all possible scenarios. As such, the need for hiking and camping equipment of a safety nature is increasingly desirable. The present invention is designed to foster a safe hiking and camping environment for all individuals.

The present invention is constructed of a lightweight single piece of pliable material which is formed into a backpack capable of storing essential survival items. The backpack is filled with survival items from a first aid kit to toilet paper to a 15" saw. Every item necessary to survive several days in the wilderness is included in the backpack described herein. The present invention becomes a stretcher in an emergency situation by folding it open, emptying the survival items and fitting it with stretcher poles included with the present invention.

The backpack as described herein can be the difference between life and death in the case of a hiking mishap. The number of people becoming lost or injured while hiking has dramatically increased as more and more amateur hikers take to the wilderness and they continue to push their physical limits by hiking in extremely rough terrains. Additionally, experienced hikers are not immune to being lost or injured making the backpack a necessity for all hikers. The news is littered with stories of people lost or injured while hiking and camping. The present invention improves the chances that lost or injured hikers and campers will remain safe until they are located.

The present invention is not only used in emergency situations but allows the hiker or camper to be prepared thereby avoiding the perils involved with hiking and camping. The ease with which the backpack described herein can be used makes it useful, and a must, for all hikers.

There are many patents issued which are directed to backpack type devices. However, the patents issued do not have the versatility or the storage capabilities of the present invention. U.S. Pat. No. 5,961,017 discloses a backpack for carrying supplies in the wilderness. Unfortunately, there is very little room for carrying survival items in a organized fashion and the backpack cannot be fully opened for easy storage and arrangement of the survival items. Similarly, U.S. Pat. No. 5,934,527 disclosed a modular backpack which is incapable of carrying many survival items in an organized fashion. Nor does the backpack open fully for easy storage of survival items. Of course, neither patent discloses an emergency stretcher which can be formed from the backpack when fully opened.

SUMMARY OF THE INVENTION

Accordingly, the present novel invention discloses a survival backpack capable of storing essential survival items and further capable of being transformed into an emergency stretcher.

The survival backpack consists of a lightweight single piece of pliable material comprised of a top flap, bottom flap, two side flaps, and a support section. One or more shoulder straps are used to carry the backpack. In its preferred embodiment the single piece of pliable material is waterproof nylon. However, those knowledgeable in the field will understand that there are any number of materials that may be used without altering the invention disclosed herein. The two side flaps are folded over the bottom flap which are then covered by the top flap which along with the support section create a backpack type device. The invention includes a means for attaching the side flaps to each other and a means for attaching the top flap to the closed side flaps. The bottom flap also includes a waterproof pocket extending the width of the backpack.

The versatility of the backpack allows it to be used as an emergency stretcher when fully opened, emptied of survival items and fitted with the stretcher poles.

The novel invention is apparent from the ease of use, the marketability to a large cross-section of users, the ability of the backpack to hold a large range of survival items and the transformation of the backpack into an emergency stretcher.

The present invention is capable of carrying any number of survival items including emergency stretcher poles, leg splints, flashlight, first aid pouch, matches, saw, utensils, etc. The single piece design allows the backpack to be used by both experienced and new hikers and campers.

Other objects, features and advantages of the present invention will be readily apparent from the following description of certain preferred embodiments. It is understood that modifications and variations may be effectuated without departing from the spirit and scope of the present invention.

DETAILED DESCRIPTION OF THE PREFERRED EMBODIMENTS

Figure 1:
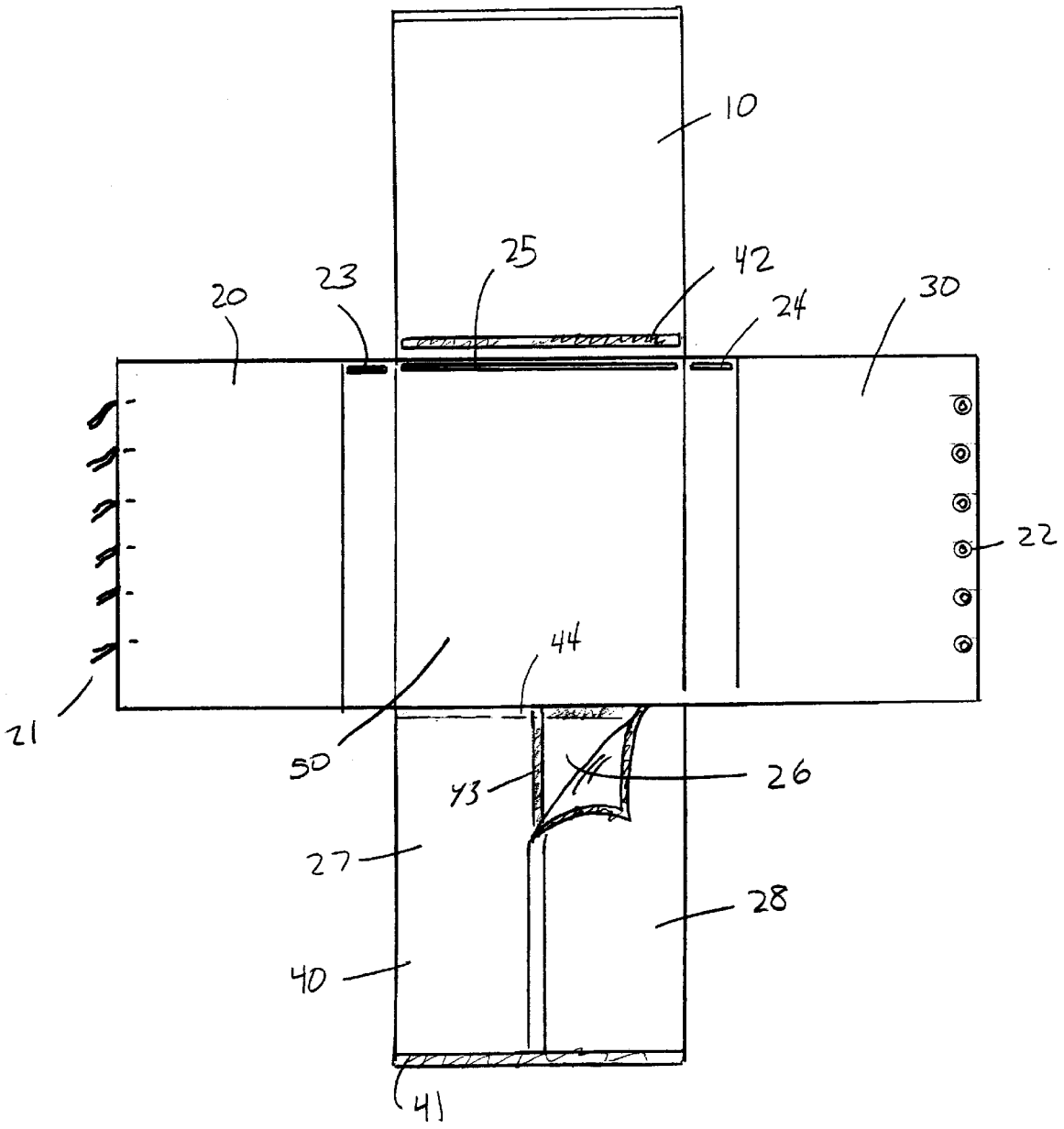
FIG. 1 is a perspective front view of the preferred embodiment of the present invention while fully opened and emptied.
Figure 2:
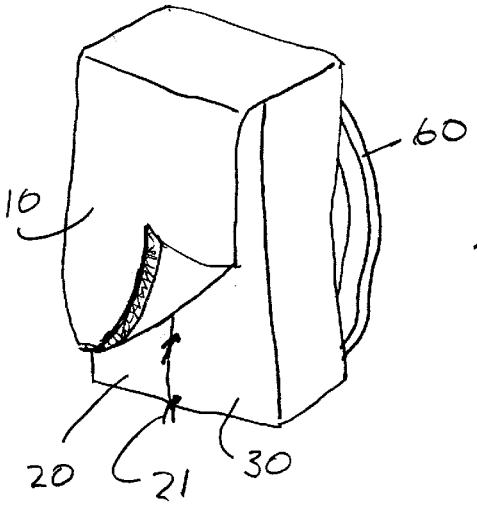
FIG. 2 is a perspective side view of the preferred embodiment illustrating the present invention in a closed state.
Figure 3:
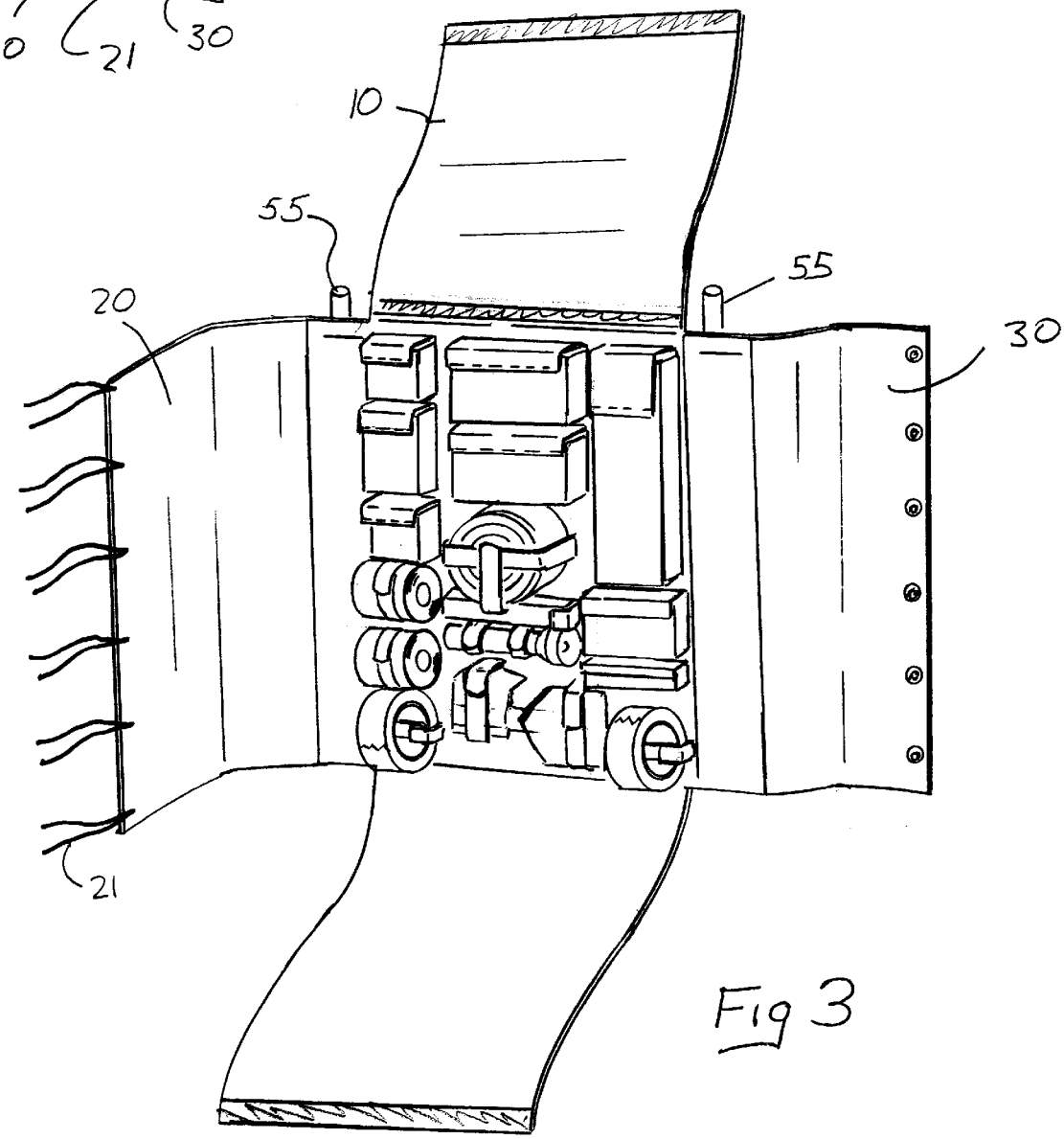
FIG. 3 is a perspective front view of the present invention illustrating survival items in place.
Figure 4:
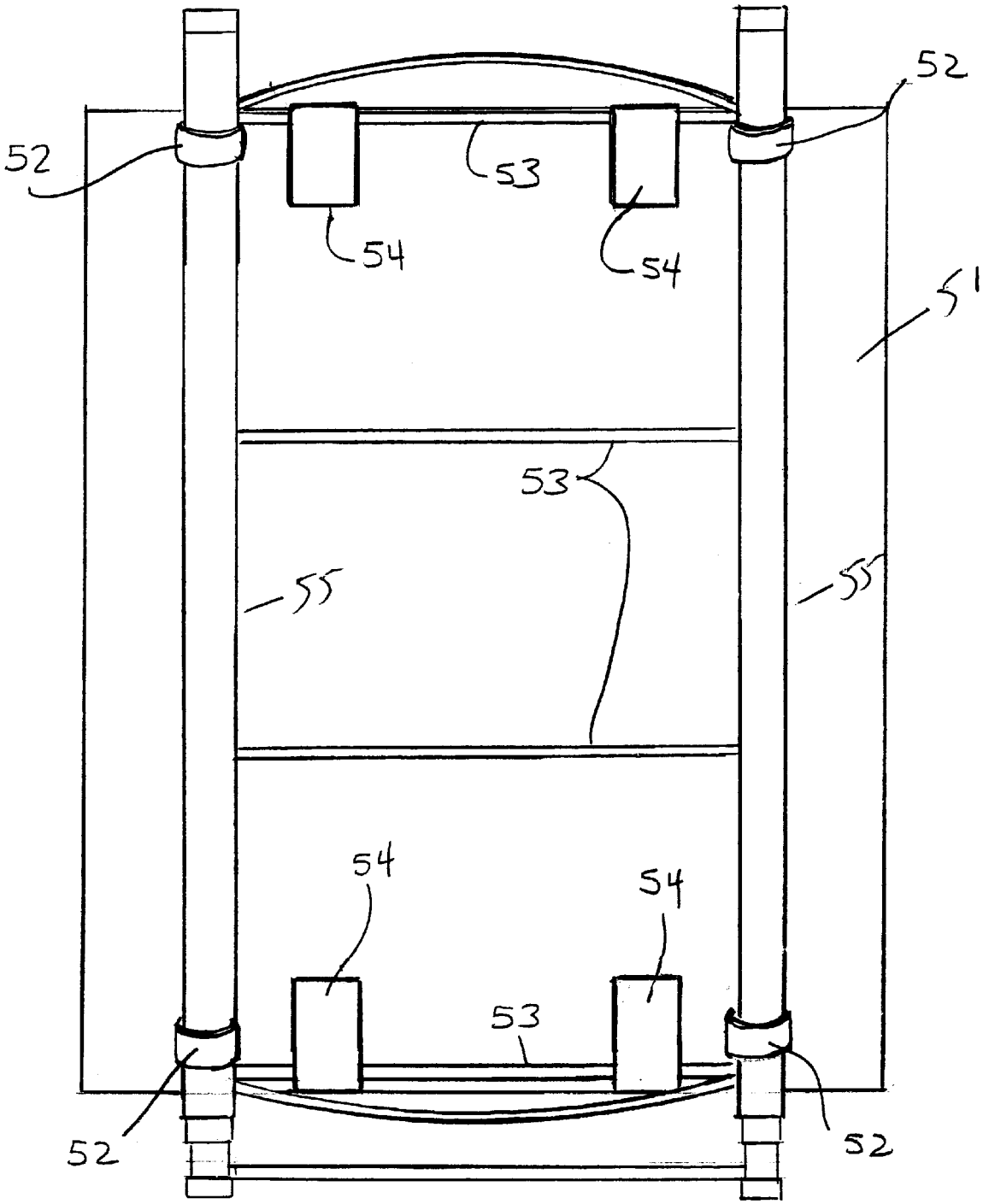
FIG. 4 is a perspective rear view of the present invention illustrating the features of the emergency stretcher.

Referring to FIGS. 1, 2, 3 & 4, the preferred embodiment of the experienced backpacker comprises a top flap 10, two side flaps 20, 30, a bottom flap 40, a support section 50 and a shoulder strap 60.

In the preferred embodiment the experienced backpacker is manufactured from waterproof nylon. Nylon affords the experienced backpacker ultimate flexibility and prevents water from entering vital storage areas. However, those skilled in the art will understand that numerous other materials can be used to manufacturer the experienced backpacker without departing from the scope and novelty of the present invention.

Two pieces of nylon material are manufactured such that when opened up and laid flat on a surface the shape of the plus (+) sign is apparent. The shape is the result of the top flap 10, the two side flaps 20, 30, the bottom flap 40 and the support section 50. The survival items to be carried in the experienced backpacker are joined to the support section 50 while in the open position by means of velcro® straps or the like.

To create the experienced backpacker the two side flaps 20, 30 are folded over the support section 50 and the enclosed survival items. A means of connecting the two side flaps 20, 30 is utilized to hold the two side flaps 20, 30 in place. In the preferred embodiment the means of connecting the two side flaps 20, 30 to one another is pack ties 21 and grommets 22 attached to the two side flaps 20, 30 respectively. The pack ties 21 are tied to the grommets 22 securely connecting the two side flaps 20, 30 to one another while making access simple. Thereafter, the bottom flap 40 is folded over the two side flaps 20, 30 which have been connected and finally the top flap 10 is folded over the bottom flap 40. Once the folding of the two side flaps 20, 30, the bottom flap 40 and the top flap 10 are completed, the experienced backpacker is formed with the support section 50 ultimately resting against a wearer's back. One or more shoulder straps 60 designed to carry the present invention are connected to an outer surface 51 of the support section 50 thus forming the experienced backpacker.

To insure the highest degree of containment the bottom flap 40 includes a velcro® strip 41 or the like along its outside bottom edge and the top flap 10 includes a velcro® strip 42 along its inside bottom edge. When fully packed and folded as described herein the velcro® strip 41 meets the velcro® strip 42 and securely holds the bottom flap 40 and top flap 10 in place.

In order to maximize the number of survival items that fit efficiently into the experienced backpacker it is designed with several inner pockets. A first pocket 23 and a second pocket 24 are incorporated into the two side flaps 20, 30 respectively. The two pockets 23, 24 extend the entire vertical length of the two side flaps 20, 30 along an inner surface of the two side flaps 20, 30 at points longitudinally adjacent to the support section 50. In the preferred embodiment the first pocket 23 and second pocket 24 are designed to hold leg splints.

A third pocket 25 is incorporated into the support section 50 of the experienced backpacker. The entire inner surface of the support section is one large pocket. In the preferred embodiment the third pocket 25 is designed to hold a stretcher board. A fourth pocket 26 is incorporated into the inner surface of the lower flap 40. The fourth pocket 26 also converts nearly the entire inner surface of the bottom flap 40 into a pocket. However, the fourth pocket 26 includes two inner flap surfaces 27, 28 capable of being fully opened to allow simple inclusion of survival items. A velcro® strip 43 connects the two inner flap surfaces 27, 28 to one another and a velcro® strip 44 is also utilized to connect upper sections of the two inner flap surfaces 27, 28 to the inner surface of the bottom flap 40.

An important feature of the experienced backpacker is its ability to transform into an emergency stretcher. Said transformation is accomplished by utilizing two stretcher poles 55 which are held into place on the outer surface 51 of the support section 50 by means of cloth strips 52. The emergency stretcher further includes cross-supports 53, which run perpendicular to the stretcher poles 55, also held in place by cloth strips 54. In the preferred embodiment the cloth strips 52, 54 are made of waterproof nylon. The stretcher poles 55 are extendable in length to afford full body support of an injured individual.

What is claimed is:

1. A backpack comprising:

a flexible top flap;

two flexible side flaps;

a flexible bottom flap;

a flexible support section;

a means for joining the two side flaps;

a means for attaching one or more survival items therein;

one or more shoulder straps and;

two extendible poles and cross-supports integrated into said support section of said backpack, said poles capable of extending beyond said top flap and said bottom flap thereby transforming the backpack, when emptied, into a stretcher.

2. The backpack as defined in claim 1 wherein the means for attaching the two side flaps are pack ties attached to the first side flap and grommets attached to the second side flap.

3. The backpack as defined in claim 1 wherein the backpack is fabricated of waterproof nylon.

4. The backpack as defined in claim 1 wherein the bottom flap, side flaps and support section include inner pockets.

* * * * *